United States Patent [19]

Rennie et al.

[11] 4,334,574

[45] Jun. 15, 1982

[54] COOLING METHOD

[75] Inventors: Andrew L. Rennie, Stirling; Alexander Davis, Hamilton, both of Scotland

[73] Assignee: BOC Limited, London, England

[21] Appl. No.: 155,911

[22] Filed: Jun. 3, 1980

Related U.S. Application Data

[63] Continuation of Ser. No. 959,408, Nov. 9, 1978, abandoned.

[30] Foreign Application Priority Data

Nov. 9, 1977 [GB] United Kingdom ..... 46715/77
Jul. 14, 1978 [GB] United Kingdom ..... 29888/78

[51] Int. Cl.[3] ..... B22C 5/08
[52] U.S. Cl. ..... 164/4.1; 164/5
[58] Field of Search ..... 164/4, 5, 154; 34/5, 34/13, 20, 36, 37; 134/2, 6, 21

[56] References Cited

U.S. PATENT DOCUMENTS

| | | | |
|---|---|---|---|
| 2,309,036 | 1/1943 | Beardsley | 34/20 X |
| 2,331,102 | 10/1943 | Bird | 164/5 X |
| 2,602,242 | 7/1952 | Dok | 34/20 X |
| 2,607,199 | 8/1952 | Christensen | 34/20 |
| 2,683,938 | 7/1954 | Gustavsson | 34/20 X |
| 2,863,190 | 12/1958 | Buhrer | 34/20 |
| 3,161,485 | 12/1964 | Buhrer | 34/20 X |
| 3,358,380 | 12/1967 | Murphy | 34/20 |
| 3,673,698 | 7/1972 | Guerard | 34/5 |
| 3,681,851 | 8/1972 | Fleming | 34/5 |
| 3,888,017 | 6/1975 | McBride | 34/5 |
| 3,958,623 | 5/1976 | Vissers et al. | 164/4 X |
| 4,141,404 | 2/1979 | McMullen | 164/5 X |

FOREIGN PATENT DOCUMENTS

| | | | |
|---|---|---|---|
| 2286682 | 4/1976 | France | 164/5 |

*Primary Examiner*—R. L. Spruill
*Assistant Examiner*—Gus T. Hampilos
*Attorney, Agent, or Firm*—David L. Rae; Larry R. Cassett

[57] ABSTRACT

Moulds are made from refractory sand (or other particulate or granular material) obtained from that sand or material. In order to control the temperature of the sand used to form the new moulds, the sand is heat exchanged with a permanent gas in liquid or solid state, or the cold vapour thereof. The temperature of the sand is sensed. The heat exchange is controlled so as to keep the sensed temperature at or below a chosen maximum.

5 Claims, 3 Drawing Figures

COOLING METHOD

This is a Continuation of Application Ser. No. 959,408, filed Nov. 9, 1978, now abandoned.

This invention relates to a cooling method. In particular, it relates to such a method as part of a method of making moulds (or parts thereof) by reusing particulate material (particularly sand) which has been obtained from moulds formed of the particulate material.

It is known to reuse the sand or other particulate material from which moulds for use in making metal castings are formed. When a metal casting has been made, it is disengaged from the mould, the material of the mould being broken away from the casting. This material is then recirculated to the hoppers of the moulding machine in which the moulds are made. It is conventional to treat this sand by adding, for example, fresh sand, water, clay and coal dust to it, to form a fresh green sand composition removing particles of metal from it, and subjecting it to a milling process so as to obtain a satisfactory material from which moulds can be formed. Typically, the water is added by spraying the water onto the sand. It is to be appreciated that the sand disengaged from the metal casting will initially be at a temperature greatly in excess of ambient. Thus, the sprays of water evaporate thereby taking heat from the sand and surrounding atmosphere.

In practice, it is important that the sand entering the moulding machines is not at too great a temperature. If it is, there will tend to be excessive evaporation of the water and as a result the non-homogeneous condition of the sand will lead to a reduction in the physical strength and other mechanical properties of the mould. However, larger quantities of water cannot be used, as excessive quantities of water in the mould will also lead to a reduction in the physical strength and other mechanical properties of the mould. Yet another difficulty that needs to be overcome is the fact that the temperature of the sand disengaged from the castings may be very variable depending on the relative proportions of sand and metal and the length of contact therebetween.

Moreover, the residence time for sand between the station at which the sand is disengaged from the castings and the moulding machines may vary according to the demands of production. Thus, in a foundry, the cooling requirement is likely to vary from day to day and from hour to hour.

Attempts have been made to overcome some of these problems by using an air and water cooling system. However, this system requires considerable capital investment which is often beyond many foundries, and, moreover, it is not sensitive to changes in the temperature of the incoming sand or the residence time of the sand between the station in which this disengaged from the castings and the hoppers of the moulding machine.

U.S. Pat. No. 3,221,381 is an example of prior proposals that recommend the use of water as a coolant. We believe that this practice is disadvantageous. The water content of the final sand should desirably be maintained in a relatively narrow range. If the sand is not sufficiently moist, the mould made from it tends to be unduly dry and friable and is therefore particularly liable to be damaged in use. If the sand is too moist, a mould made from the sand tends to be unduly plastic. Moreover there is a tendency for the moisture to undergo a detrimental reaction with molten metal poured into the mould. It is thus desirable in systems such as illustrated in U.S. specification 3,221,381 to provide a control system which can keep the moisture content of sands within chosen limits.

With water as a coolant, it is sometimes, we believe impossible to achieve both adequate moisture control and adequate temperature control. Other specifications that recommend the use of water as a coolant are U.S. Pat. Nos. 3,324,566, and 3,519,252 and French specification No. 1,239,680.

It is an object of the present invention to provide a method of making moulds in which sand or other particulate or granular material is obtained from used moulds and then cooled by means of a permanent gas, in solid or liquid state, or the vapour of such solidified or liquified permanent gas.

According to the present invention there is provided a method for making moulds including the steps of obtaining sand, or other particulate material, from used moulds formed of the sand or other particulate material; passing the sand, or other particulate material, to a station where moulds are formed therefrom, monitoring the temperature of the sand, or other particulate material, at the said station or on its way to the station, and causing a permanent gas in liquid or solid state to vaporise in or upstream of a cooling region, the so-formed vapour being heat-exchanged with the sand, or other particulate material in the cooling region on its way to the station, the heat exchange being controlled so as to keep the monitored temperature of the sand or other particulate material at or below a chosen temperature.

The preferred cooling medium is liquid nitrogen. There are preferably means for spraying the liquid nitrogen directly on to the sand or means for otherwise effecting heat exchange between the liquid nitrogen (and/or its cold vapour) and the sand. Such means preferably communicate with the interior of a chamber through which the sand passes. It is possible to use liquefied gases other than liquid nitrogen. For example, liquid argon may be used. On some occasions it might be possible to use liquid carbon dioxide or solid carbon dioxide. It is not necessary for there to be direct contact between the cooling medium and the sand though this is preferred. If desired, the cooling medium, if a fluid, may be passed through a conduit through which the sand is, in operation, passed and the resultant cold vapour introduced into the cooling region.

If the cooling medium is liquid nitrogen, or other liquefied gas, it is preferred to recirculate cold vapour evaporating therefrom either to the chamber (or chambers) in which the cooling is performed, or possibly, to a hopper, or other part of the sand handling system, upstream of the chamber (or chambers) into which the liqid nitrogen or other cooling medium is introduced.

The chamber or chambers in which the cooling of the sand is performed may be part of an already established sand handling system. In particular, the chamber may be a disintegrator used to perform a final reduction in size of agglomerated sand (or other particles) in an established sand handling system. If desired, the housing of the disintegrator may be thermally insulated. It may be that there is no such disintegrator available for the introduction of the cooling medium. If so, a chamber or cooling tunnel may be inserted in the established sand handling system.

Preferably, a region of the path followed by the sand or other particulate material relatively close to the moulding station is chosen for the cooling. It is the time it takes for the sand to reach the moulding stations therefrom that is of importance. This time should be relatively short. The location where the cooling is performed should desirably be downstream of any station at which the sand is held in storage for an appreciable length of time on its way to the moulding station. Nonetheless, it may be desirable to contact the sand with the liquefied gas or its vapour (or both) as the sand falls under gravity into a hopper. In a typical arrangement the hopper has a screen placed over its inlet, and the liquefied gas is sprayed or otherwise directed at the sand as it falls through the hopper.

The temperature of the sand is preferably monitored upstream of the location where the cooling is performed. The aim of the cooling is to give an approximately constant sand temperature at the moulding station. Accordingly, the temperature may be monitored downstream of the region or regions where the cooling is performed. Typically, the temperature is sensed in the hopper(s) of(a) moulding machine(s). The chosen temperature will depend upon the composition of the sand or other particulate material from which the mould is formed, its content of other material such as water, coal dust and clay, and the metallurgical and mechanical properties that the castings formed in the moulds are required to have. Thus, it is not possible to make a universal generalisation as to what this temperature should be. However, in many instances, we believe that the monitored temperature should always be kept below 40° C. It is an advantage of method and apparatus according to the invention, we believe, that the chosen temperature may be altered according to changes in the above-mentioned parameters.

A temperature sensor located such that it is in good thermal contact with the sand (or other particulate material) may be operatively associated with at least one valve in a pipeline or pipelines from which the liquid gas is supplied. In a preferred arrangement, there are a number of automatically operated flow control valves in parallel with one another. The valves are programmed so as to vary the rate at which liquefied gas comes into contact with the sand (or other particulate material) in accordance with the temperature sensed upstream of the location where the cooling is performed. Thus, if the sensed temperature is, say, ten degrees C. above the desired temperature, say, just one valve may be open, and if the sensed temperature, is, say, twenty degrees C. above the desired temperature, say, two valves may be open, thereby doubling the rate of passage of liquefied gas to the cooling zone.

We believe that in practice the temperature of the sand may fluctuate quite considerably. It is important that the time taken for the sand (or other particulate material) to pass from the region where its temperature is sensed to the region where the cooling takes place is greater than the response time of the means for automatically controlling the introduction of the liquefied gas into the cooling region.

If desired, the cooling may be supplemented in a secondary cooling zone. Typically, this zone may be located in the hopper of a moulding machine at the moulding station. Preferably, as aforementioned there is a temperature sensor in a good thermal contact with the surface of the sand (or just underneath the surface) in the hopper. The temperature sensor may be operatively associated with a valve or valved controlling the spraying of liquefied gas at sand falling into the hopper after having passed through a screen situated over the mouth of the hopper. Control means for the valve or valves may be programmed such that the spraying takes place only when the sensed temperature is above a chosen value. By this means it is possible to compensate for any inadequacy in the main cooling.

Typically, the or each temperature sensor used to monitor the temperature of the sand upstream of the (main) sand cooling region is held by or maintained on a pivoted arm which moves against the bias of a spring. This makes it possible for the sensor to be held at approximately the same depth beneath the surface of the sand on a conveyor forming part of the sand handling plant at different sand loadings. In view of the abrasive action of the sand or other particulate material, it may be necessary to change the or each temperature sensor at regular intervals.

Typically if the method according to the invention is used to cool sand in an established green sand handling plant, there will be at least one mill in which the sand being re-used is mixed with fresh sand, clay and other additures. It is preferred that the cooling (or main cooling) is performed downstream of the or each such mill.

The method according to the invention makes it possible, we believe, to keep down the number of moulds and castings that are rejected for faults or defects such as bad lifts and scabbing which we believe arise from excessive sand temperature. The method also helps, we believe, to form a green sand having a controlled moisture content. It also makes possible, we believe, a reduction in the proportions of additives such as that they need to be added to form a green sand. In addition the method according to the invention may be operated on an established sand recirculation system with relatively little capital expenditure. The method according to the invention will now be described by way of example with reference to the accompanying drawings, of which:

Figure 1:
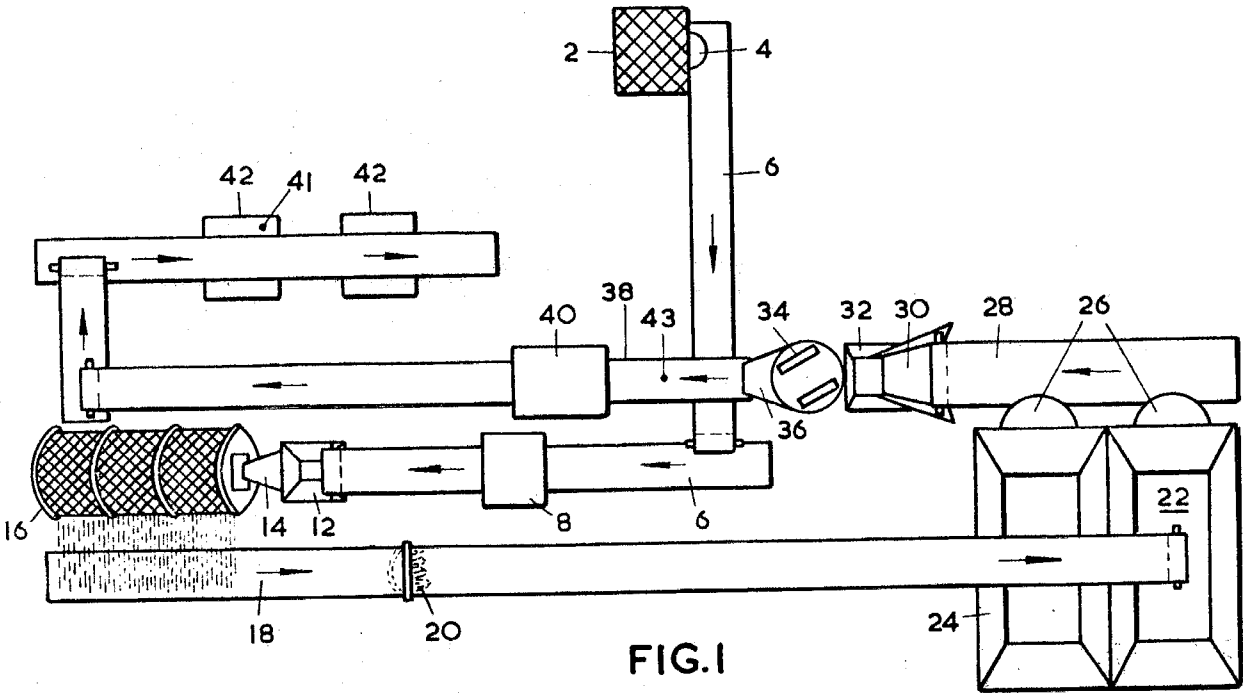
FIG. 1 is a schematic diagram illustrating a sand handling plant.

Referring to FIG. 1 of the drawings, a knockout grid 2 is adapted to separate the material of sand moulds from a casting formed therein, the sand being broken into lumps of varying sizes during this operation. The knockout grid has a discharge opening 4 situated above a conveyor 6. Situated downstream of the knockout grid 2 and above the conveyor 6 is situated a magnetic separator 8. The purpose of this separator is to separate from the sand particles of metal that have become incorporated in the sand as a result of casting operations.

Downstream from the magnetic separator 8 the conveyor 6 terminates above a hopper 12 which has an outlet chute 14 which is adapted, in use, to feed the lumps of sand into a rotary drum 16, a part of whose walls is formed of mesh or like material so that it functions as a screen, and in which may be disposed chains or like members for use in breaking up the lumps of sand.

Below the rotary drum 16 is situated another conveyor 18 through which sand particles may fall. Situated above the conveyor 18 are jets 20 for introducing water on to the sand as it passes there below. The conveyor 18 terminates in an inlet 22 to a relatively large hopper 24 in which quantities of sand may, if desired, be held. The hopper 24 has discharge openings 26 situated above another conveyor 28. Sand from the hopper 24 may thus be discharged on to the conveyor 28. The conveyor 28 terminates above a hopper 30 whose outlet 32 is adapted to feed the sand into a rotary impact mill 34. Typically, clay and coal dust may be added to the sand at this stage so as to "recondition" it.

Figure 2:
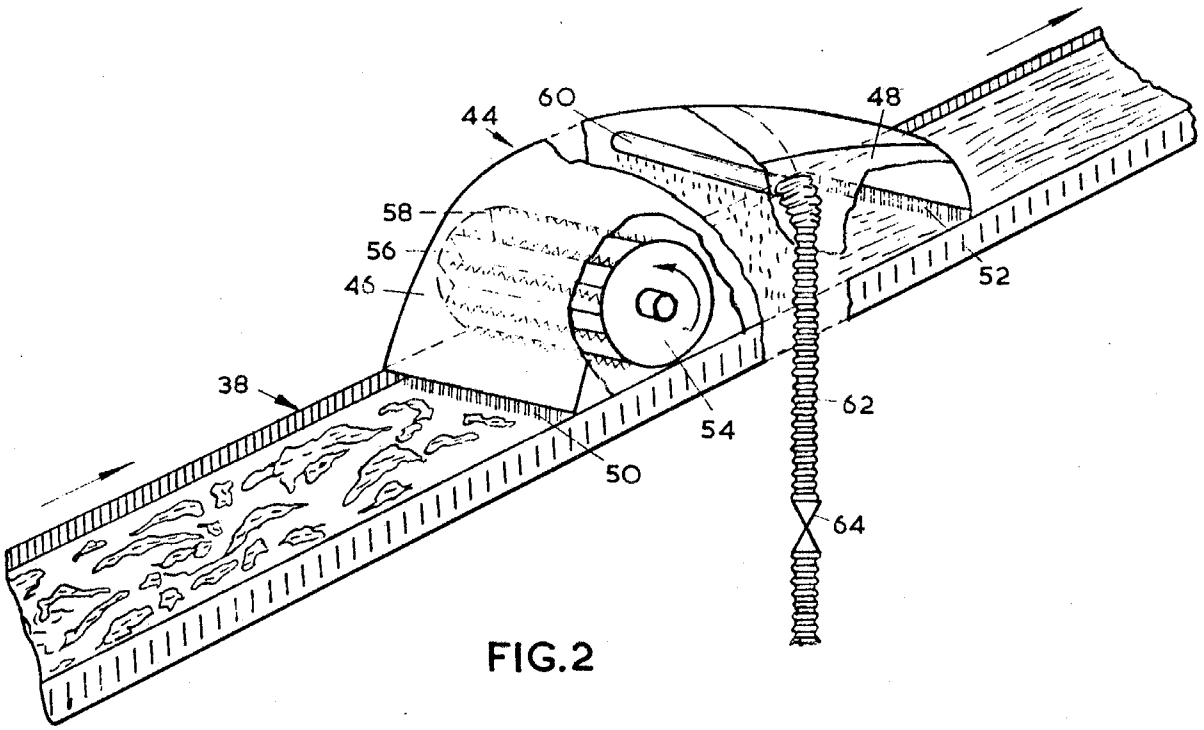
FIG. 2 is a schematic drawing, partly in perspective, illustrating the disintegrator forming part of the plant shown in FIG. 1

The mill 34 has an outlet chute 36 discharging above a conveyor 38 which passes through a disintegrator 40 which is shown in FIG. 2. At or near its end, the conveyor 38 is arranged so as to feed the sand into the hoppers 42 of moulding machines (not shown) in which new moulds are formed.

As shown in FIG. 2, the disintegrator 40 has a chamber 44 having inclined walls 46 and 48 formed at their bottoms with castellated rubber skirts 50 and 52, the rubber skirts being contiguous with the surface of the conveyor 38 such that sand may pass through the castellations into the chamber 44. Located in the chamber 44 is a rotary impeller 54 whose blades 56 are formed with teeth 58. If desired the blades may be coated with PTFE. Downstream of the impeller 54 is situated a spray header 60. The chamber 44 may be more than a meter long with the impeller 54 being located at one end and the spray header 60 at the other.

The spray header 60 is connected to an insulated pipe 62 having a solenoid valve 64 disposed therein. The solenoid valve 64 is operatively associated with a temperature sensor 43 (FIG. 3) situated upstream of the disintegrator 40 and downstream of the mill 34 in good thermal contact with the sand as it passes along the conveyor 38. In operation, the impeller helps to break up lumps of sand entering the chamber 44. Liquid nitrogen may then be sprayed onto the sand through the spray header 60 which is connected to a source of liquid nitrogen (not shown), (or other dry permanent gas in liquid or solid state) via the pipeline 62. The valve 64 is associated with temperature sensor 43 through electronic controls (not shown) such that liquid nitrogen is sprayed into the disintegrator chamber 44 only when the sensed temperature rises to a chosen value (eg. 40° C.). The arrangement may often be such that if the sensed temperature falls below a lower limit, eg. 35° C., the valve 64 may be closed.

If desired, a temperature sensor 41 may be located in one of the hoppers of the moulding machine so as to check that the said has been adequately cooled.

Typically, the sand falling onto the conveyor 6 may have a temperature in the range 80°-200° C. As it is conveyed under the magnet 8, so the particles of ferrous metals are extracted therefrom. The sand is then passed into the hopper 12 and thence into the rotary drum 16 on to the conveyor belt 18. The sand is then conveyed under the water sprays 20. Typically, the quantity of water added is from 2-4% by weight of the sand. The mixture of sand and water then falls into the hopper 24 and is discharged onto the conveyor 28 and enters the hopper 30 which serves the rotary mill 34. Chosen quantities of clay and coal dust may then be added to the sand in the mill. The resultant mixture is discharged on to the conveyor 38 and is passed through the disintegrator 40 where it is cooled by means of liquid nitrogen in the manner described above. The cooled mixture is then passed into the hoppers 42 where its temperature is sensed.

If desired, nitrogen vapour, evaporating in the disintegrator 40 may be conducted to a stack (not shown) associated with the rotary screen 16.

Figure 3:
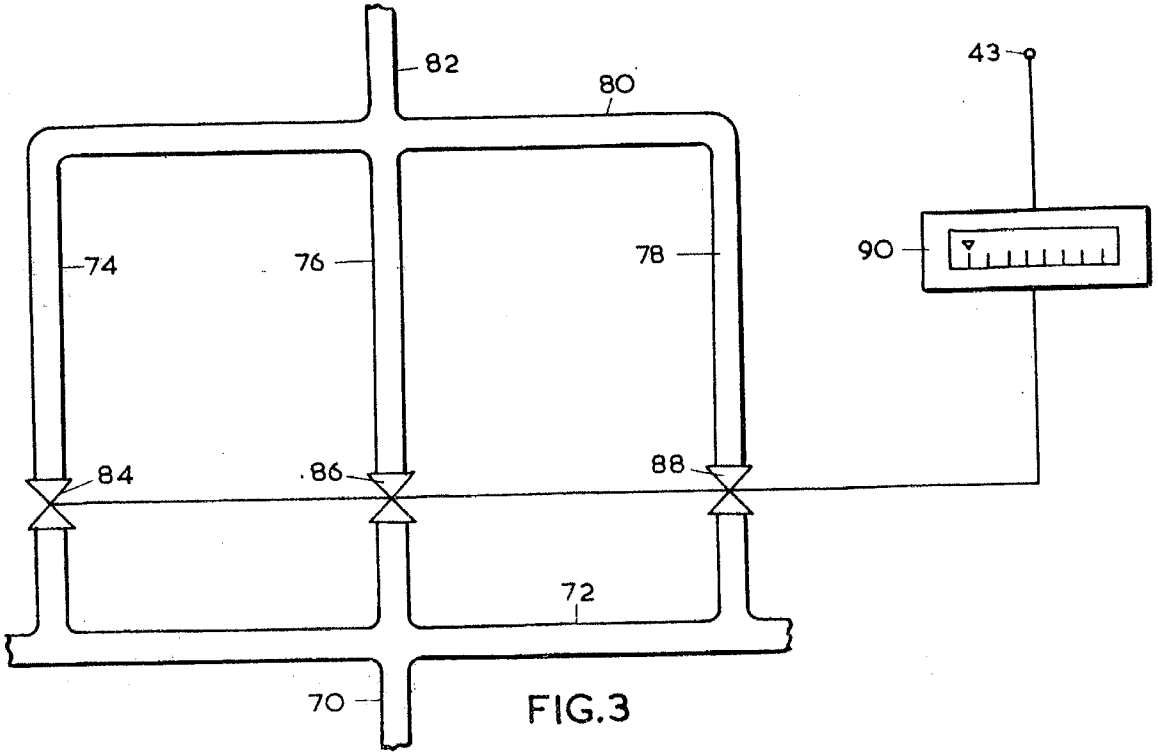
FIG. 3 is a schematic drawing illustrating a liquefied gas supply system for use with the plant shown in FIG. 1.

With reference to FIG. 3 of the drawings a typical system for controlling the supply of liquid nitrogen to the spray header 60 comrises a pipe 70 in communication with a source (not shown) of liquid nitrogen. The pipe 70 terminates in a main pipe 72 which feeds three subsidiary pipes 74, 76 and 78 in parallel with one another. The subsidiary pipes all terminate in another main pipe 80 in communication with which is a pipe 82 which terminates in the spray header 60 (not shown in FIG. 3).

Solenoid operated flow control valves 84, 86 and 88 are located in the pipes 74, 76 and 78 respectively. The opening and closing of the valves 84, 86 and 88 are controlled by a temperature controller 90 which is operatively associated with the temperature sensor 43.

The temperature controller 90 is programmed as follows. If the said temperature sensed by the sensor 43 is below or at a chosen temperature T1 (say 40° C.) then all three valves are in their closed positions. If the sensed temperature is between $T_1$ and a second temperature $T_2$ (say, 50° C.) the valve 84 is in its open position, and the valves 86 and 88 are in their closed position. Thus liquid nitrogen will pass through the valve 84 to the spray header 60 at a chosen rate. If the sensed temperature is between $T_2$ and a third temperature T3 (say, 60° C.) the valves 84 and 86 are in their open positions and the valve 88 is in its closed position. Thus liquid nitrogen will pass through the valves 84 and 86 to the spray header at double the rate it does when just the valve 84 is open. If the sensed temperature rises above $T_3$ all three valves will be opened and liquid nitrogen will pass through the valves 84, 86 and 88 at theree times the rate it does when just the valve 84 is open. It can thus be appreciated that the hotter the sand, the more liquid nitrogen comes into contact with it.

The necessary electrical control circuitry need to effect the above mentioned operation of the valves is well known in the art.

The invention is further illustrated by the following example. A green sand comprising 4% by weight of water, 10% by weight of clay, and from 3 to 5% by weight of coal dust substitute, the balance being silica sand, was formed in the plant shown in FIG. 1. The temperature of the sand was measured just upstream and downstream of the disintegrator. The upstream temperature is indicated by $T_1$ in Table 1, and the downstream temperature by $T_2$. The downstream temperature was maintained below 40° C.

The variation in upstream and downstream temperatures is shown in Table 1. The properties of the resultant green sand are shown in Table 2.

Over a period of three months operating the process according to the invention it has been found that the proportion of reject moulds has been 5% compared with 12% when the plant shown in FIG. 1 is operated without liquid nitrogen cooling.

SAND TEMPERATURE

| Time | $T_1$ | $T_2$ | Time | $T_1$ | $T_2$ |
|---|---|---|---|---|---|
| 9.55 | 31 | 26 | 11.48 | 37 | 33 |
| 10.00 | 38 | 30 | 1.00 | 38 | 34 |
| 10.05 | 35 | 22 | 1.05 | 40 | 25 |
| 10.08 | 35 | 17 | 1.15 | 35 | 22 |
| 10.13 | 32 | 24 | 1.25 | 35 | 27 |
| 10.16 | 40 | 24 | 1.35 | 33 | 28 |
| 10.20 | 39 | 21 | 1.41 | 37 | 27 |
| 11.00 | 35 | 28 | 1.50 | 38 | 26 |
| 11.03 | 38 | 25 | 1.56 | 38 | 23 |

-continued

| | | | | | |
|---|---|---|---|---|---|
| 11.05 | 38 | 20 | 2.03 | 36 | 22 |
| 11.06 | 35 | 23 | 2.08 | 36 | 24 |
| 11.10 | 39 | 24 | 2.20 | 38 | 24 |
| 11.12 | 40 | 24 | 2.25 | 37 | 22 |
| 11.17 | 39 | 20 | 2.40 | 38 | 24 |
| 11.20 | 38 | 20 | 2.50 | 35 | 26 |
| 11.22 | 38 | 28 | 2.55 | 38 | 22 |
| 11.29 | 37 | 23 | 3.10 | 35 | 30 |
| 11.39 | 35 | 33 | 3.20 | 40 | 23 |
| 11.43 | 38 | 37 | 3.25 | 42 | 26 |

SAND PROPERTIES

| Time | Moisture % by weight of sand | Green Strength lbs/sq inch | Permeability | Shatter Index |
|---|---|---|---|---|
| 8.00 | 4.3 | 17 | 90 | 78 |
| 9.00 | 4.3 | 17 | 90 | 75 |
| 10.00 | 3.9 | 17 | 90 | 68 |
| 11.00 | 4.5 | 16.2 | 100 | 72 |
| 1.00 | 3.7 | 17 | 90 | 65 |

No. of reject moulds during day: 8
Total no. of boxes produced: 309
Total time nitrogen on: 2.0 hr
Total nitrogen consumption: 12.6 HCM (Hundred cubic meters)

We claim:

1. A method for making moulds comprising the steps of obtaining sand from used moulds at a temperature above that temperature that is desired for making new moulds; passing said sand to a mould station where moulds are formed therefrom; spraying liquefied gas selected from the group consisting of liquid nitrogen, liquid argon and liquid carbon dioxide into direct contact with said sand to thereby cool said sand as it is passed to the mould station; monitoring the temperature of said sand as it is passed to said mould station; and controlling the flow of said liquefied gas in response to said monitored temperature to establish the temperature of said sand below a predetermined value prior to making moulds from the cooled sand.

2. The method defined in claim 1 wherein the step of monitoring said sand temperature in the passage of said sand to said mould station comprises sensing said temperature upstream of said heat exchange between said liquefied gas and said sand.

3. The method defined in claim 1 wherein the step of monitoring said sand temperature in the passage of said sand to said mould station comprises sensing the temperature downstream of said heat exchange between said liquefied gas and said sand.

4. The method defined in claim 1 wherein said step of passing said sand to a mould station comprises introducing sand into a disintegrator device wherein clumps of sand are substantially disintegrated; and wherein said step of passing said flow of liquefied gas in heat exchange relation with said sand comprises introducing said liquefied gas into said disintegrator device thereby cooling said sand therein.

5. In the manufacture of metal casting moulds from a composition of preselected water content comprising foundry sand recovered from a prior casting operation and which is at an undesirably high temperature from heat absorbed by the mould from the hot metal of a prior casting operation the improvement which comprises removing heat from the sand by direct exchange of heat with a liquefied gas selected from the group consisting of liquid nitrogen, liquid argon and liquid carbon dioxide sprayed onto the sand in an amount controlled by a sensed temperature of the sand to thereby obtain the desired sand temperature for the formation of metal casting moulds without altering the water content thereof.

* * * * *